US007472709B1

(12) United States Patent
Nickerson

(10) Patent No.: US 7,472,709 B1
(45) Date of Patent: Jan. 6, 2009

(54) PERFECT NAIL SYSTEM

(76) Inventor: Paula Nickerson, 2000 C Shenandoah Ct., Plymouth, MN (US) 55447

( * ) Notice: Subject to any disclaimer, the term of this patent is extended or adjusted under 35 U.S.C. 154(b) by 0 days.

(21) Appl. No.: 11/589,023

(22) Filed: Oct. 27, 2006

Related U.S. Application Data

(60) Provisional application No. 60/742,017, filed on Dec. 2, 2005.

(51) Int. Cl.
*A45D 29/18* (2006.01)

(52) U.S. Cl. ..... 132/73.5

(58) Field of Classification Search ..... 132/73, 132/73.5, 75, 76.5, 285, 286; 206/581; 220/23.2, 220/23.4, 23.86, 23.88, 507, 555
See application file for complete search history.

(56) References Cited

U.S. PATENT DOCUMENTS 2,020,100 A * 11/1935 Boyd ..... 434/100
2,978,285 A * 4/1961 Jester ..... 312/284
4,083,452 A * 4/1978 Rossmo ..... 206/533
4,296,766 A * 10/1981 Benis ..... 132/73
5,425,460 A * 6/1995 Barbarian ..... 211/77
5,427,121 A 6/1995 Polito ..... 132/200
5,469,992 A * 11/1995 Jenkins ..... 222/362

OTHER PUBLICATIONS

U.S. Appl. No. 60/742,071, filed Dec. 2, 2005, Nickerson.

* cited by examiner

*Primary Examiner*—Robyn Doan
*Assistant Examiner*—Rachel A Running
(74) *Attorney, Agent, or Firm*—Vidas, Arrett & Steinkraus, P.A.

(57) ABSTRACT

A system for applying nail polish to a nail, the system including a container having a wall and within the wall of the container is a plurality of compartments, each compartment configured for retaining a spray-on container for nail polish. The container may include a lid with a handle. The container may include a rotating member for rotating each compartment to an opening which is located either in the wall of the container or in the lid. The handle of the lid is engaged to the rotating member and when the handle is rotated, the rotating member rotates accordingly. This system may be used in combination with a nail clip for protecting the skin and cuticle of a finger or toe while exposing the nail.

2 Claims, 2 Drawing Sheets

PERFECT NAIL SYSTEM

CROSS-REFERENCE TO RELATED APPLICATIONS

This application claims the benefit of U.S. Provisional Application No. 60/742,017, filed Dec. 2, 2005, the entire contents of which are hereby incorporated herein by reference.

FIELD OF THE INVENTION

The present invention relates generally to the filed of cosmetology, in particular, to application of polish to the surface of fingernails and toenails.

BACKGROUND OF THE INVENTION

It is ever increasingly popular for individuals to enhance their beauty through a variety of cosmetic techniques, for example, enhancing the beauty of hands and feet by applying nail polish to the nails of the hands and feet.

The most common method of application is to use an applicator brush to apply the polish to the nails. This method is quite time consuming, and imperfections can result from brush marks, or from objects sticking to the brush, causing difficulty in obtaining a smooth application.

Furthermore, some individuals may lack the coordination required from both hands, particularly the left hand if one is right handed, in order to get a full and precise application to the nail without applying it to the skin around the nail as well.

For these reasons, in recent years it has become more popular to use spray-on acrylic nail enamel. U.S. Pat. No. 5,427,121 discloses a method of applying color to the surface of nails of the hands and feet in the form of a base coat, a spray-on acrylic paint and a top sealing coat. Once the top sealing coat is dry, the user washes their hands with soap and water so as to remove any overspray of acrylic paint which came into contact with the surrounding skin or cuticle.

There remains a need in the art for an improved method of applying polish to the nails of the hands and feet which is not time consuming, does not require ambidexterity, and which allows for accurate and precise application a smooth coat without getting polish on the skin surrounding the nail or on the cuticle.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. §1.56(a) exists.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

SUMMARY OF THE INVENTION

The present invention relates to a perfect nail system and method of applying polish to the nails of the hands and feet including a clear container having a plurality of compartments, each compartment configured to retain a container of spray-on nail polish. The container further comprises a member for rotating each compartment to a single location of the container. At this location, is an opening configured for insertion of a finger such that the nail is positioned in front of the nozzle of the spray-on nail polish container. The opening may further include a finger guard for retaining the finger in position for application of the nail polish.

In one embodiment, the container includes four compartments, each compartment may include a container of base coat, a container of nail color, a container of top coat, and a container of white French nail tip color, for example. Of course, the containers may contain whatever a user desires, and be changed from time to time as desired, particularly when a different nail color may be desired.

In some embodiments, the container may include two, three, four, or more compartments.

For example, in an embodiment wherein the container has three compartments, there may be included a spray-on container of base coat, nail color, and top coat.

In one embodiment, the spray-on nail polish containers have a triangular shape in the radial direction of the container.

The rotating device may be in the form of a lazy Susan. The lazy Susan configured for receiving the lid of the container. The lid of the container further includes a handle such that when the handle is rotated, the lazy Susan rotates.

The container may further be configured with an arm that will come down on top of each spray-on container of paint such that when the arm is pressed down, the container of spray-on paint, will be induced to spray.

The container is configured such that there is no overspray of polish or paint getting to the outside of the container.

In another embodiment, the present invention relates to a nail clip which may be positioned on the finger around the nail such that when polish is applied to a nail, either in the form of a brush-on polish or a spray-on paint, the clip prevents the nail polish from reaching the skin surrounding the nail or the cuticle.

The clip may be employed in combination with the perfect nail system disclosed herein, or may be employed with other nail polishing techniques such as a brush-on polish.

These and other aspects, embodiments and advantages of the present invention will become immediately apparent to those of ordinary skill in the art upon review of the Detailed Description and Claims to follow.

DETAILED DESCRIPTION OF THE INVENTION

While this invention may be embodied in many different forms, there are described in detail herein specific embodiments of the invention. This description is an exemplification of the principles of the invention and is not intended to limit the invention to the particular embodiments illustrated.

All published documents, including all US patent documents, mentioned anywhere in this application are hereby expressly incorporated herein by reference in their entirety. Any copending patent applications, mentioned anywhere in this application are also hereby expressly incorporated herein by reference in their entirety.

Depicted in the figures are various aspects of the invention. Elements depicted in one figure may be combined with, or substituted for, elements depicted in another figure as desired.

Figure 1:
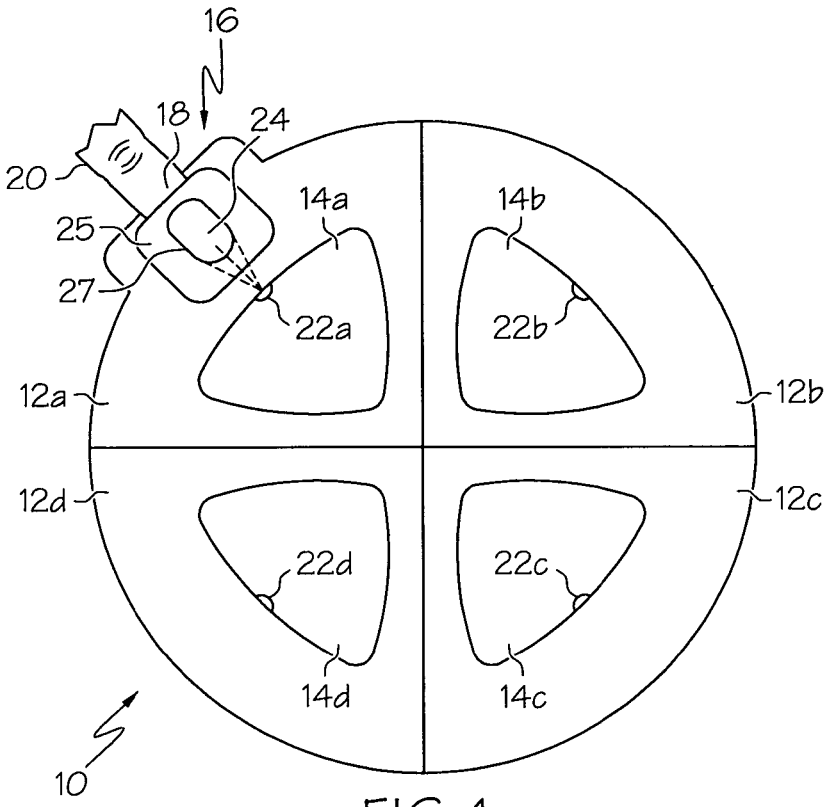
FIG. 1 is a top down view illustrating one embodiment of the nail system according to the invention.

Turning now to the figures, FIG. 1 is a top down view of a nail system 10 according to the invention.

Nail system 10 is shown having four compartments 12*a*, 12*b*, 12*c*, 12*d*, each compartment shown retaining a container or can 14*a*, 14*b*, 14*c*, 14*d* respectively, for spray-on nail polish. Containers 14*a*, 14*b*, 14*c*, 14*d* may include base coat, nail color, top coat, and white French nail tip color, in any order, for example. Suitably, each coating will be positioned in compartments in order of use. Of course, container 10 may include a different number of compartments 12 such as two, three, four, five or more. Furthermore, any combination of different types of coating materials may be included in the kit as well.

Suitably, container 10 is in the form of a clear plastic or glass. Clear plastic being preferable because a lighter weight can be obtained for easy transport of the container from one location to another.

While container 10 is shown having a circular or round configuration, other configurations such as oval, square, etc., may be employed, providing that the compartments 12*a*, 12*b*, 12*c*, 12*d* on the interior of the container may be allowed to move freely. Furthermore, the spray cans 14*a*, 14*b*, 14*c*, 14*d* may also be configured of a different geometry, suitably, to fit accordingly with compartments 12*a*, 12*b*, 12*c*, 12*d*.

Figure 2:
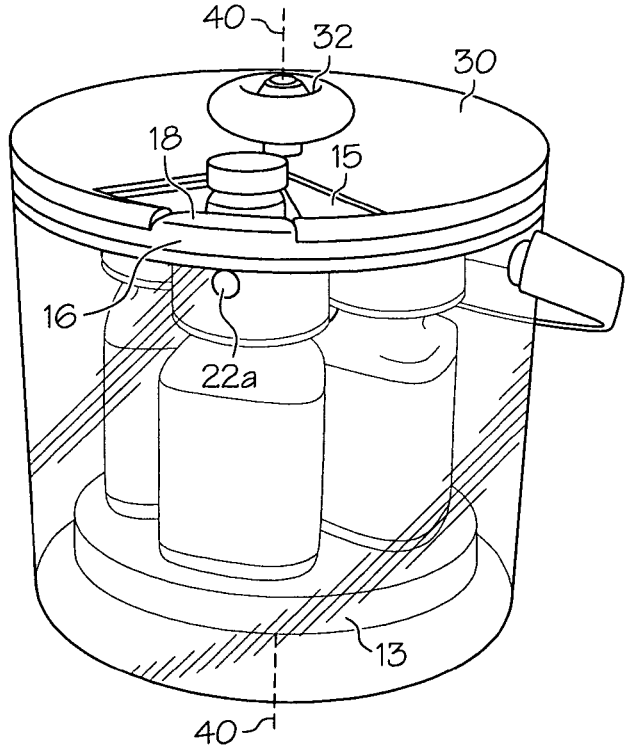
FIG. 2 is a side perspective view illustrating an embodiment similar to that shown in FIG. 1.

Container 10 further includes a rotating member 13 shown in FIG. 2 in a form similar to that of a lazy Susan. However, any suitable configuration may be employed. Rotating member 13 allows each can 14*a*, 14*b*, 14*c*, 14*d* of spray-on nail coating may be easily moved to a position 16 shown in FIGS. 1 and 2. At position 16 of the container 10, there is further included an opening 18 into which a finger 20 may be inserted. Suitably, the opening is just large enough to insert a finger such that during spraying of the nail coating, the nail coating does not escape the interior of the container.

Alternatively, the opening 18 of container 10 may be configured with a finger guard 15 for holding the finger in place for painting while allowing a larger opening.

The container may be equipped with a lid 30. In the embodiment shown in FIG. 2, lid 30 is equipped with a handle 32 which is further interconnected to the rotating member 13 such that when lid 30 is rotated, rotating member 13 also rotates about the same axis 40.

As can be seen from the drawing, each can 14*a*, 14*b*, 14*c*, 14*d* is shown with a spraying device 22*a*, 22*b*, 22*c*, 22*d* respectively, such as a nozzle. Nozzle 22*a* is illustrated spraying coating onto nail 24 of finger 20 in FIG. 1. Spray containers of the type disclosed in U.S. Pat. No. 5,427,121, the entire content of which is incorporated by reference herein, may be employed herein.

A pad of paper (not shown) may be located around the finger guard or wall of the compartment to catch most of the overspray inside of the compartment. The top page of each pad may be removed after each use to keep the perfect nail system looking clean. Once the pad is depleted, it may be replaced with a new one.

A nail clip 25 is shown positioned on finger 20 such that it fits around nail 24 to prevent coating from getting onto the skin or cuticle (not shown) surrounding nail 24. Nail clip 25 has an opening 27 which is constructed and arranged to expose a nail of a finger or toes.

Figure 3:
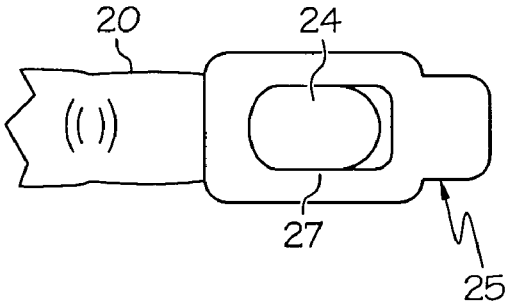
FIG. 3 is a top view of one embodiment of the nail clip according to the invention.
Figure 4:
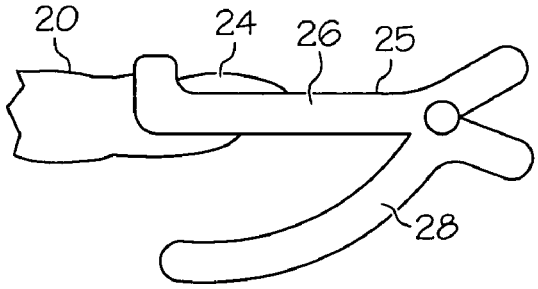
FIG. 4 is a side view of a nail clip similar to that shown in FIG. 3.

A top down view of an embodiment of clip 25 is shown in FIG. 3. A side view of clip 25 is shown in FIG. 4.

Clip 25 may be formed from any suitable polymeric material or foamed version thereof. Depending on the preference of the user, it may be a hard polymer material or it may be a soft polymer material. Clip 25 may be configured to hold the skin around the nail down and away from the nail.

If clip 25 is made from a hard plastic or polymer material, it may be suitable to include the top arch of the clip which fits over the cuticle to include a softer material, at least on the inside, such that it is more comfortable for the user. This can be any softer material including softer polymer material, foamed polymer material, cloth, etc. This can further include a small ridge on the inner surface which pulls back the cuticle providing a straight curved edge at the base of the nail. A wire inside the top may be included to allow for custom shaping.

The clip 25 may be further equipped with a biasing means such as a spring (not shown). Clip 25 shown in FIG. 4 has a top 26 and a bottom 28. Opening 27 is located in the top 28 of clip 25. The clip 25 may be clipped onto the finger similar to a clothes pin. Suitably the biasing means is firm to hold the sides of the finger down, and to hold the plastic sides of the clip in place when in use.

Clips can be further configured such that the nail base is covered and only the tip of the nail is exposed for a French manicure, or the clip may be configured to provide a two-tone paint job. This may further be accomplished through the use of inserts which are inserted into the clip to cover more of the nail surface area, for example.

Suitably, clips are available in a variety of sizes to accommodate different size hands and nails. Furthermore, different sizes may be needed for fitting a thumb, or pinkie, than for other fingers on the hand, for example. Slide designs are infinite.

Figure 5:
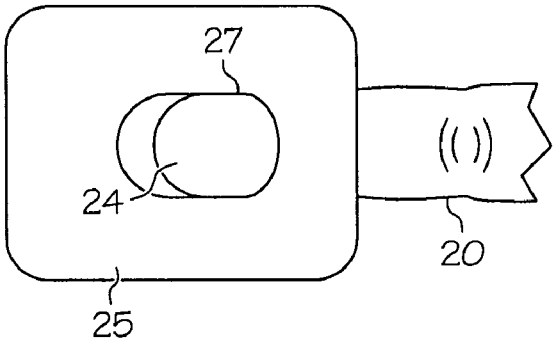
FIG. 5 is a top view of an alternative embodiment of a nail clip according to the invention.
Figure 6:
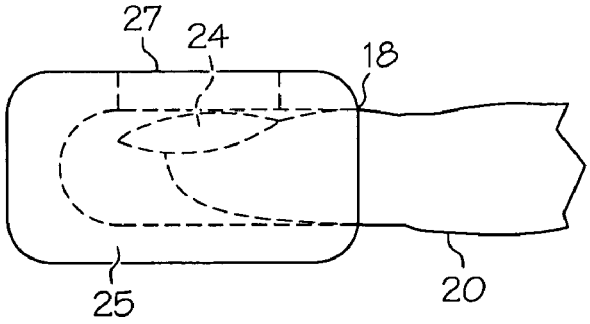
FIG. 6 is side view of a nail clip similar to that shown in FIG. 5.

An alternative embodiment of clip 25 is shown as a top down view in FIG. 5. In this embodiment, clip 25 has more of a sleeve-like configuration. FIG. 6 is a side view illustrating a similar sleeve-like clip 25 positioned on finger 20.

The sleeve may or may not have a biasing means. In the case of a hard plastic, it may have a biasing means. If formed from an elastic material, it may fit over the finger snugly without a biasing means.

Thus, the present invention offers an improved, spin and spray perfect nail system.

The above disclosure is intended to be illustrative and not exhaustive. This description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

The invention claimed is:

1. A device for applying spray-on polish to the nails of hands or feet, the device comprising a container having a central axis of rotation, the container having a wall which is formed from a clear material, the container comprising:

a plurality of compartments, each compartment configured for retaining a spray-on container for nail polish;

a plurality of spray-on polish containers an opening configured for positioning a finger therein;

rotating member for rotating each compartment to the opening of the container; and a lid, the lid comprising a handle, the handle engaging with said rotating member such that when said handle is rotated, the rotating member rotates about the central axis of rotation.

2. A device for applying spray-on polish to the nails of hands or feet, the device comprising a container and a finger cover, the container having a central axis of rotation, the container having a wall which is formed from a clear material, the container comprising:

a plurality of compartments, each compartment configured for retaining a spray-on container for nail polish;

an opening configured for positioning a finger therein;

rotating member for rotating each compartment to the opening of the container; and a lid, the lid comprising a handle, the handle engaging with said rotating member such that when said handle is rotated, the rotating member rotates about the central axis of rotation;

the finger cover having an opening constructed and arranged for exposing a nail for spray-on application of nail polish, the finger cover configured and arranged to fit within the opening of the container, said finger cover inserted within said opening of the container.

* * * * *